US007767036B2

(12) United States Patent
Kashima et al.

(10) Patent No.: US 7,767,036 B2
(45) Date of Patent: Aug. 3, 2010

(54) HIGH STRENGTH COLD ROLLED STEEL SHEET AND PLATED STEEL SHEET EXCELLENT IN THE BALANCE OF STRENGTH AND WORKABILITY

(75) Inventors: Takahiro Kashima, Kakogawa (JP); Yoichi Mukai, Kakogawa (JP); Hiroshi Akamizu, Kakogawa (JP); Koichi Sugimoto, Nagano (JP)

(73) Assignee: Kabushiki Kaisha Kobe Seiko Sho (Kobe Steel, Ltd.), Kobe-shi (JP)

( * ) Notice: Subject to any disclaimer, the term of this patent is extended or adjusted under 35 U.S.C. 154(b) by 356 days.

(21) Appl. No.: 11/910,013

(22) PCT Filed: Mar. 29, 2006

(86) PCT No.: PCT/JP2006/306462

§ 371 (c)(1),
(2), (4) Date: Sep. 28, 2007

(87) PCT Pub. No.: WO2006/106733

PCT Pub. Date: Oct. 12, 2006

(65) Prior Publication Data

US 2008/0251161 A1 Oct. 16, 2008

(30) Foreign Application Priority Data

Mar. 30, 2005 (JP) ..... 2005-098952

(51) Int. Cl.
*C22C 38/02* (2006.01)
*C22C 38/04* (2006.01)
*C22C 38/06* (2006.01)
*B32B 15/01* (2006.01)

(52) U.S. Cl. ..... 148/320; 148/334; 148/333; 428/659

(58) Field of Classification Search ..... 148/320, 148/333, 334, 651–653, 662, 533; 428/659
See application file for complete search history.

(56) References Cited

U.S. PATENT DOCUMENTS 6,280,538 B1 8/2001 Soshiroda et al.

(Continued)

FOREIGN PATENT DOCUMENTS

JP 1-159317 6/1989

(Continued)

OTHER PUBLICATIONS

U.S. Appl. No. 12/303,566, filed Dec. 5, 2008, Nakaya, et al.

(Continued)

*Primary Examiner*—Deborah Yee
(74) *Attorney, Agent, or Firm*—Oblon, Spivak, McClelland, Maier & Neustadt, L.L.P.

(57) ABSTRACT

A high-strength cold-rolled steel sheet exhibiting an excellent strength-workability balance, including in percent by mass:
0.10-0.25% of C;
1.0-2.0% of Si;
1.5-3.0% of Mn;
0.01% or less (not including 0%) of P;
0.005% or less (not including 0%) of S;
0.01-3.0% of Al; and
remaining part consisting of iron and inevitable impurities,
wherein the space factor of bainitic ferrite to the entire structure is 70% or more,
the space factor of residual austenite to the entire structure is 5-20%,
the hardness (HV) is 270 or greater, and
the half-value width of an X-ray diffraction peak on a (200)-surface of α-iron is 0.220 degrees or smaller.

17 Claims, 3 Drawing Sheets

U.S. PATENT DOCUMENTS

| | | | |
|---|---|---|---|
| 6,540,846 | B2 | 4/2003 | Kashima et al. |
| 6,554,918 | B2 | 4/2003 | Kashima et al. |
| 7,008,488 | B2 | 3/2006 | Akamizu et al. |
| 7,090,731 | B2 | 8/2006 | Kashima et al. |
| 2003/0084966 | A1 | 5/2003 | Ikeda et al. |
| 2004/0035500 | A1 | 2/2004 | Ikeda et al. |
| 2004/0159373 | A1 | 8/2004 | Ikeda et al. |
| 2005/0081966 | A1 | 4/2005 | Kashima et al. |
| 2005/0150580 | A1 | 7/2005 | Akamizu et al. |
| 2005/0161134 | A1 | 7/2005 | Ikeda et al. |
| 2005/0167007 | A1 | 8/2005 | Miura et al. |
| 2005/0247378 | A1 | 11/2005 | Ikeda et al. |
| 2006/0130937 | A1 | 6/2006 | Ikeda et al. |
| 2006/0137768 | A1 | 6/2006 | Yuse et al. |
| 2006/0137769 | A1 | 6/2006 | Yuse et al. |
| 2006/0169366 | A1 | 8/2006 | Yuse et al. |
| 2006/0169367 | A1 | 8/2006 | Yuse et al. |
| 2007/0023113 | A1 | 2/2007 | Ikeda et al. |

FOREIGN PATENT DOCUMENTS

| | | |
|---|---|---|
| JP | 1-272720 | 10/1989 |
| JP | 2003-193190 | 7/2003 |
| JP | 2003-193193 | 7/2003 |
| JP | 2004-190050 | 7/2004 |
| JP | 2004-332099 | 11/2004 |
| JP | 2004-332100 | 11/2004 |

OTHER PUBLICATIONS

U.S. Appl. No. 12/303,634, filed Dec. 5, 2008, Nakaya, et al.
U.S. Appl. No. 12/305,998, filed Dec. 22, 2008, Saito, et al.
U.S. Appl. No. 12/162,878, filed Jul. 31, 2008, Mukai et al.
U.S. Appl. No. 12/477,299, filed Jun. 3, 2009, Ikeda, et al.
O. Castelnau, et al., "Dislocation Density Analysis in Single Grains of Steel by X-ray Scanning Microdiffraction", Nuclear Instruments and Methods in Physics Research A, vol. 467-468, Aug. 7, 2001, pp. 1245-1248.
U.S. Appl. No. 11/910,029, filed Sep. 28, 2007, Akamizu, et al.
U.S. Appl. No. 11/736,813, filed Apr. 18, 2007, Kashima.

HIGH STRENGTH COLD ROLLED STEEL SHEET AND PLATED STEEL SHEET EXCELLENT IN THE BALANCE OF STRENGTH AND WORKABILITY

CROSS-REFERENCE TO RELATED APPLICATIONS

The present application is a 35 U.S.C. §371 National Stage patent application of International patent application PCT/JP/06/306462, filed on Mar. 29, 2006, which claims priority to Japanese patent application JP 2005-098952, filed on Mar. 30, 2005.

TECHNICAL FIELD

The present invention relates to a high-strength cold-rolled steel sheet exhibiting an excellent strength-workability balance and a plated steel sheet, and more particularly, to a technique for improving a TRIP (Transformation Induced Plasticity) steel sheet.

BACKGROUND ART

For press molding and bending work of high-strength parts and components of an automobile, an industrial machine and the like, a cold-rolled steel sheet used for such processing needs be excellent in both strength and workability. The recent years have seen a rising need, driven by a reduction of the weight of an automobile, to a cold-rolled steel sheet which has an even higher strength, and a TRIP steel sheet in particular is gaining an increased attention as a cold-rolled steel sheet which meets the need.

A TRIP steel sheet is a steel sheet in which an austenite structure remains present and which significantly elongates as residual austenite ($\gamma_R$) is induced to transform into martensite due to stress when processed and deformed at a temperature equal to or higher than the martensitic transformation start temperature (Ms point). Known as such are a few types, including for example a steel sheet whose matrix is polygonal ferrite and which contains residual austenite, a steel sheet whose matrix is tempered martensite and which contains residual austenite, a steel sheet whose matrix is bainitic ferrite and which contains residual austenite, a steel sheet whose matrix is bainite and which contains residual austenite (as that described in patent Document 1, for example), etc.

Of these, a steel sheet whose matrix contains bainitic ferrite and residual austenite is characterized in that it is easy to attain a high strength due to hard bainitic ferrite, it is easy to generate very fine residual austenite at the boundary of lath bainitic ferrite and such a morphological structure realizes excellent elongation. Further, there is an advantage related to manufacturing that such a steel sheet is easily produced through one thermal treatment (continuous annealing or plating).

However, even this steel sheet has a problem that as its strength increases, the workability decreases. To solve the problem, Patent Document 2 proposes a high-strength thin steel sheet in which one type or more from among Ni, Cu, Cr, Mo and Nb is added to a basic component composition for better hydrogen-resistant embrittlement, weldability and hole expanding capability. However, owing to the existence of bainitic ferrite to which an alloy element is indispensable and whose matrix has an extremely high dislocation density, a further improvement of ductility including total elongation is considered to be difficult. Meanwhile, it is desirable to reduce an alloy element from the perspectives of a cost, recycling, etc.

Patent Document 1: JP 01-159317, A
Patent Document 2: JP 2004-332100, A

DISCLOSURE OF INVENTION

The present invention has been made under this circumstance, and accordingly, an object of the present invention is to provide a cold-rolled steel sheet which exhibits a further improved balance between its tensile strength and its workability and whose tensile strength is 800 MPa or higher and to provide a plated steel sheet.

A high-strength cold-rolled steel sheet exhibiting an excellent strength-workability balance according to the present invention satisfies in percent by mass (as generally applied to any chemical component below):

0.10-0.25% of C;
1.0-2.0% of Si;
1.5-3.0% of Mn;
0.01% or less (not including 0%) of P;
0.005% or less (not including 0%) of S; and
0.01-3.0% of Al, the remaining part consists of iron and inevitable impurities, the space factor of bainitic ferrite to the entire structure is 70% or more, the space factor of residual austenite to the entire structure is 5-20%, the hardness (HV) is 270 or greater, and the half-value width of an X-ray diffraction peak on a (200)-surface of $\alpha$-iron is 0.220 degrees or smaller.

The high-strength cold-rolled steel sheet above may further contain 0.3% or less (not including 0%) of Mo and/or 0.3% or less (not including 0%) of Cr, and further, 0.1% or less (not including 0%) of Ti and/or 0.1% or less (not including 0%) of Nb. It may further contain 50 mass ppm or less (not including 0%) of Ca.

The present invention encompasses a plated steel sheet as well which is obtained by plating the surfaces of the high-strength cold-rolled steel sheet above, and the plating may be galvanizing.

According to the present invention, it is possible to provide a high-strength cold-rolled steel sheet which exhibits an even better balance between its tensile strength and its workability (total elongation, stretch flange) and which makes it possible to work upon high-strength parts and component of an automobile or the like, and to provide a plated steel sheet.

BEST MODE FOR CARRYING OUT THE INVENTION

The inventors of the present invention have been intensively studying the matrix, which is bainitic ferrite, of such a TRIP steel sheet above which easily secures ductility, in an effort to further improve a strength-workability balance.

Figure 1:
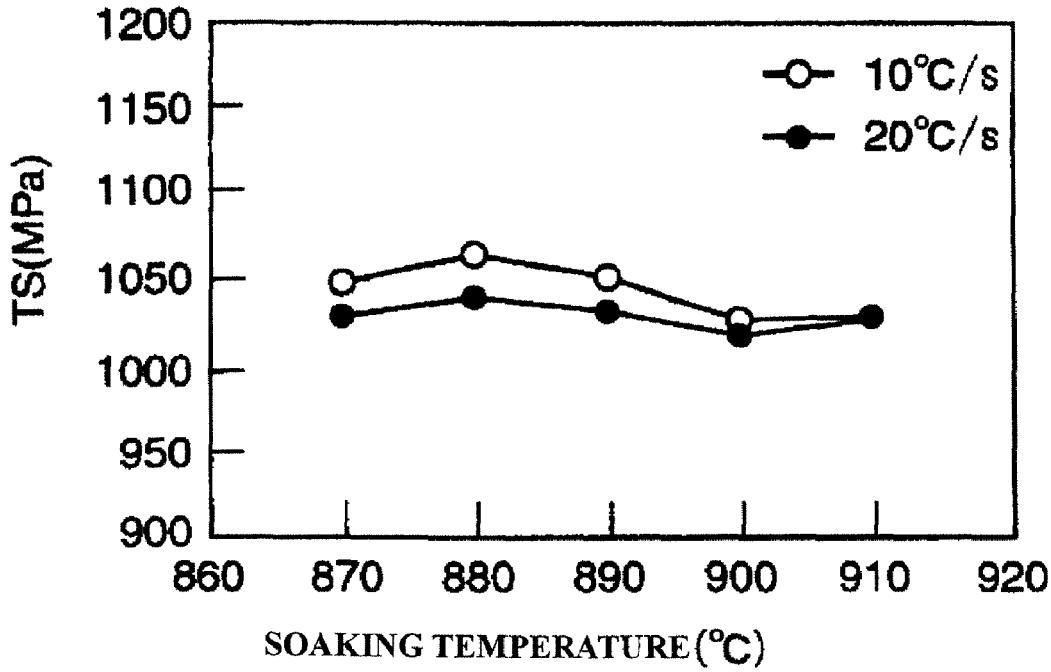
FIG. 1 is a graph of the influence upon a tensile strength exerted by a soaking temperature (T1) and an average cooling rate (CR)
Figure 2:
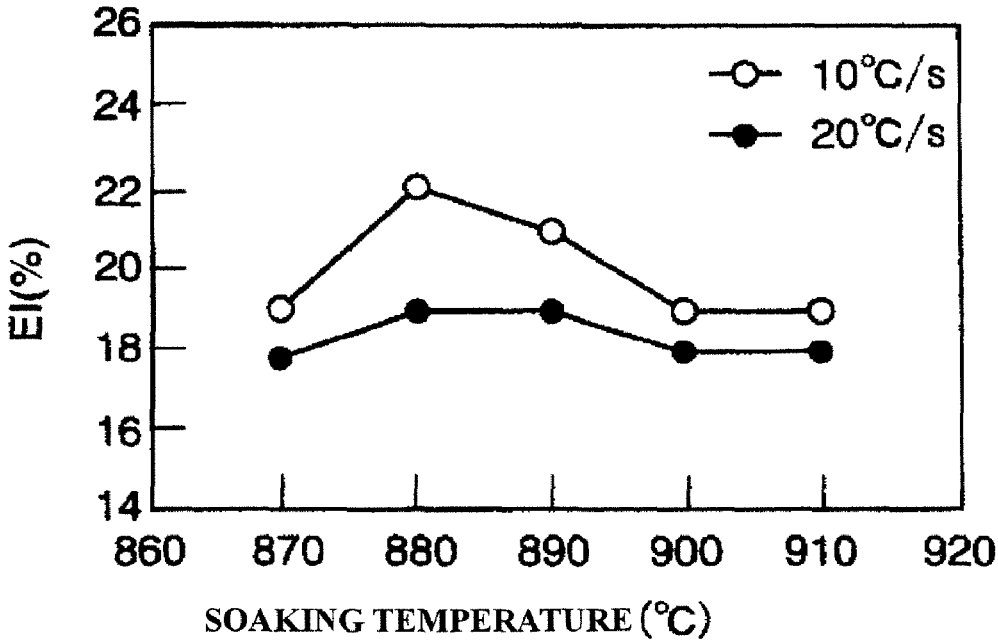
FIG. 2 is a graph of the influence upon elongation (El) exerted by the soaking temperature (T1) and the average cooling rate (CR)
Figure 3:
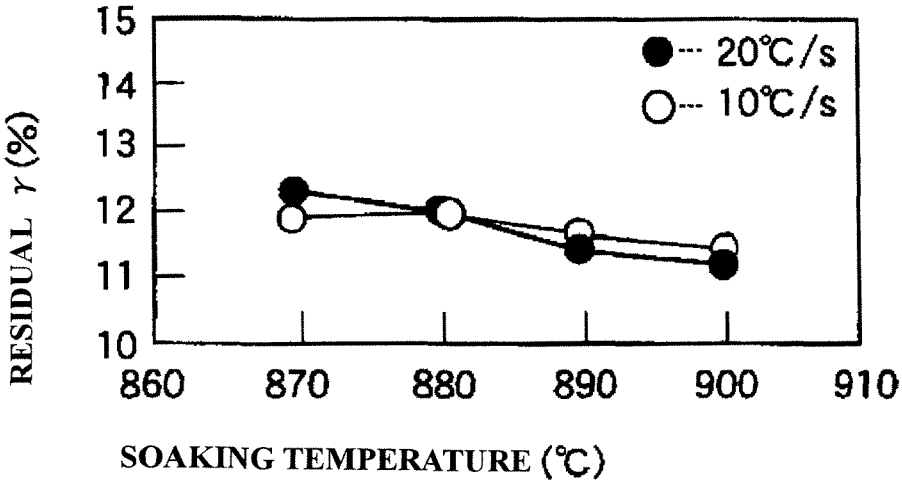
FIG. 3 is a graph of the influence upon residual austenite exerted by the soaking temperature (T1) and the average cooling rate (CR)

FIGS. 1 through 3 show the results of measurements taken in examples described later on the tensile strengths (TS), the elongation [total elongation (El)] and the residual austenite (residual γ) of steel sheets which were manufactured using the same steel grade satisfying a component composition according to the present invention, with the soaking temperature (T1) in a thermal treatment pattern (FIG. 4) described later set to 870-900° C. and the average cooling rate (CR) changed between 10° C./s and 20° C./s. FIGS. 1 through 3 show that while the tensile strength was approximately constant irrespective of the soaking temperature during the thermal treatment and the average cooling rate (FIG. 1), elongation changed depending on the soaking temperature and the average cooling rate (FIG. 2). To note in particular is that the steel materials obtained at the soaking temperature of 880° C., despite the approximately same amounts of the residual austenite as shown in FIG. 3, were remarkably different in terms of elongation depending upon the average cooling rate. The inventors of the present invention examined these steel materials in detail and found that as Table 1 shows, among the steel materials obtained at the soaking temperature of 880° C., those exhibiting great elongation (namely, those which were cooled at the speed CR of 10° C./s) had small half-value widths of peaks on Fe which were relevant to the dislocation densities of the matrixes and appeared in X-ray diffraction (i.e., measurement conducted under the conditions according to Embodiments described later) on the matrixes (α-iron). Measuring the elongation of the steel materials which were manufactured under various conditions and whose Fe-peak half-value widths were different, the inventors found that the smaller the Fe-peak half-value widths were, the greater the elongation was.

TABLE 1

| | HALF-VALUE WIDTH OF PEAK (DEGREES) | | | |
|---|---|---|---|---|
| CR (° C./s) | (110)-SURFACE | (200)-SURFACE | (211)-SURFACE | (222)-SURFACE |
| 20 | 0.150 | 0.234 | 0.202 | 0.252 |
| 10 | 0.143 | 0.192 | 0.169 | 0.205 |

Further, exploring a quantitative relationship between the Fe-peak half-value widths and an improvement of the elongation, the inventors found that when the half-value width on the (200)-surface of α-iron above (hereinafter sometimes referred to as the "Fe-peak half-value widths") was 0.220 degrees or smaller (preferably, 0.205 degrees or smaller), the elongation dramatically increased and the strength-workability balance further improved.

Although not clarified sufficiently, a mechanism that elongation remarkably increases when a Fe-peak half-value width is reduced may be as follows. That is, while a TRIP steel sheet exhibits excellent workability as processing transforms residual austenite as described above, the workability is greatly dependent upon the property of the matrix at the initial stage of the processing (deformation), and it is therefore considered that the ductility of the matrix itself is largely influential over the ductility of the steel sheet. Where the matrix has a small Fe-peak half-value width as in the present invention, it is believed that the dislocation density is low and the ductility of the matrix improves. Hence, due to full exhibition of the ductility of the matrix at the initial stage of the processing and the subsequent TRIP effect of residual austenite manifesting itself even more effectively, the workability is thought to be excellent in total. In other words, in the present invention, through control of the matrix, a steel sheet which contains residual austenite and the like at the same ratio as that of a conventional steel sheet can fully exhibit the effect attributable to transformation of residual austenite.

Since a Fe-peak half-value width as that described above obtained during X-ray diffraction described above is indicative of the degree of introduced strain which is related to the dislocation density, a Fe-peak half-value width measured in any crystal orientation has an approximately same tendency. The present invention uses a Fe-peak half-value width taken on a (200)-surface with the most evident tendency as a representative Fe-peak half-value width.

Although no particular lower limit value of the Fe-peak half-value width above is set, considering that the matrix structure of the steel sheet according to the present invention is not polygonal ferrite but is bainitic ferrite, the lower limit of the Fe-peak half-value width is considered to be approximately 0.180 degrees.

For the effect above to be fully felt, and hence, for an improvement of the strength-workability balance, it is necessary that the structure of the steel sheet according to the present invention satisfies the following requirements.

<Bainitic Ferrite (BF) Accounts for 70% or More.>

As described above, the present invention is directed to a TRIP steel sheet whose matrix is bainitic ferrite with which it is easy to ensure ductility, and the space factor of bainitic ferrite to the entire structure is preferably 70% or beyond. The space factor is preferably 80% or beyond, and further preferably 90% or beyond. The upper limit of the space factor can be determined by a balance with other structures (such as residual austenite), and in the event that there is not other structures (such as martensite) than residual austenite described later, the upper limit is controlled to 95%.

"Bainitic ferrite" mentioned above in the present invention refers to a structure which contains a lath substructure, a granular substructure and the like whose dislocation densities are high, and is clearly different from a bainitic structure which contains in its structure carbides which are in a certain morphological state. It is different also from a polygonal ferrite structure whose dislocation density is zero or extremely low ("Photo Collection of Bainite in Steel-1", Basic Research Group, Iron and Steel Institute of Japan).

<Residual Austenite (Residual γ) Accounts for 5-20%.>

Residual austenite is useful in improving total elongation, and to effectively exhibit this function, it needs be present at the space factor of 5% (preferably 8% or larger, preferably 10% or larger, and further preferably 15% or larger) to the entire structure. On the contrary, since excessive presence deteriorates the stretch flange formability, the upper limit is set to 20%.

Further, the concentration of C in $\gamma_R$ described earlier is preferably 0.8% or higher. This is because $C\gamma_R$ is significantly influential over the TRIP (Transformation Induced Plasticity) characteristic, and when controlled to be 0.8% or higher, improves elongation, the stretch flange formability, etc. The concentration is preferably 1.0% or higher, and further preferably 1.2% or higher. Although the higher the $\gamma_R$ above is, the more preferable, an adjustable upper limit is generally 1.5% considering an actual operation.

While the steel sheet according to the present invention may consist only of the structure above (which is a mixed structure of bainitic ferrite and residual austenite), only to an extent not detrimental to the function of the present invention, the steel sheet may contain martensite, carbides and the like as other structures. These are structures which could be inevitably generated during a manufacturing process according to the present invention. The less these are present, the more preferable. In the present invention, these are controlled down to 15% or less, and preferably, 10% or less.

Since the matrix of the steel sheet according to the present invention is bainitic ferrite and the steel sheet does not contain a large amount of polygonal ferrite unlike conventional steel sheets, the Vickers hardness (Hv) of the steel sheet is 270 or greater. The matrix becomes extremely soft and voids are created at the boundary between polygonal ferrite and residual austenite during processing if polygonal ferrite is contained in a big volume, which makes it hard for the workability improving effect attributable to transformation of residual austenite to be felt sufficiently.

While the present invention is characterized in controlling the structure in particular in the manner described above, in order to make it easy to form this structure and improve the balance between the tensile strength and the workability, the component composition of the steel sheet needs fall under the ranges below.

<C: 0.10-0.25%>

C is an element which is essential in securing a high strength while maintaining residual austenite. In more detailed words, this is an important element to ensure that the solid solubility of C in the austenite phase is sufficient so that the austenite phase as desired remains present even at a room temperature, and is useful to improve the strength-workability balance. Hence, the amount of C is 0.10% or greater, preferably 0.15% or greater, and further preferably 0.18% or greater. However, since C present in an excessive amount deteriorates the weldability, the amount of C is controlled to 0.25% or less, and preferably 0.23% or less.

<Si: 1.0-2.0%>

Si is an element which is useful as an element which enhances the solid solubility, while being an element which effectively suppresses decomposition of residual austenite and generation of carbides. In light of this, the amount of Si is 1.0% or greater, and preferably 1.2% or greater in the present invention. However, since Si in an excessive amount adversely affects the workability, Si is controlled to 2.0% or less, and preferably 1.8% or less.

<Mn: 1.5-3.0>

Mn is an element which is necessary to stabilize austenite and obtain desirable residual austenite. For this effect to be emerged effectively, Mn needs be contained at 1.5% or more, preferably 1.8% or more. On the other hand, since Mn in an excessive amount reduces residual austenite and causes a casting crack, Mn is 3.0% or less, and preferably 2.7% or less.

<P: 0.01% or Less (Not Including 0%)>

Since P decreased the workability, the less P is, the more desirable. P is preferably 0.01% or less.

<S: 0.005% or Less (Not Including 0%)>

S is an unpreferable element which generates a sulfide inclusions such as MnS, serves as a point of origin of a crack and deteriorates the workability (stretch flange formability in particular), and therefore, it is desirable to reduce S as much as possible. S is controlled to 0.005% or less, and preferably 0.003% or less.

<Al: 0.01-3.0%>

Al is an element which is added for the sake of deoxidation in molten steel, and deoxidation with Al achieves an Al-content in steel of 0.01% or greater. However, since inclusions such as alumina increases and the workability deteriorates as the amount of Al increases, the upper limit is set to 3.0%.

The elements contained in the composition according to the present invention are as described above, and the remaining part is substantially Fe. Nevertheless, it is needless to mention that as inevitable impurities remained in steel due to raw materials, resources, manufacturing equipment or other factor, 0.01% or a smaller amount of N (nitrogen) and the like are acceptable, and that still other elements can be positively added as long as they do not deteriorate the properties of the present invention as described below.

<0.3% or Less (Not Including 0%) of Mo and/or 0.3% or Less (Not Including 0%) of Cr>

Mo and Cr are useful as elements which strengthen steel and are effective in stabilizing residual austenite. For this effect to be emerged effectively, it is preferable that 0.05% or more (0.1% or more in particular) of each is contained. However, since excessive addition saturates their effect, Mo and Cr are 0.3% or less.

<0.1% or Less (Not Including 0%) of Ti and/or 0.1% or Less (Not Including 0%) of Nb>

Ti and Nb are useful in strengthening steel due to precipitation strengthening and microstructure fining effects. For this effect to be emerged effectively, it is recommended to add 0.01% or more (0.02% or more in particular) of each. However, since excessive addition saturates the effect and lowers the economic efficiency, each is 0.1% or less (preferably 0.08% or less, and further preferably 0.05% or less).

<50 ppm or Less of Ca (Not Including 0%)>

Ca is an element which is effective in controlling the morphology of sulfides in steel and improving the workability. For this effect to be emerged effectively, it is recommended to add 5 ppm or more (10 ppm or more in particular) of Ca. However, since excessive addition saturates the effect and lowers the economic efficiency, Ca is controlled preferably to 50 ppm or less (30 ppm or less in particular).

Although the present invention does not specify manufacturing conditions as well, it is recommended that a thermal treatment is performed in the following manner after cold rolling in order to obtain, using a steel material which satisfies the component composition above, the above structure which has a high strength and is excellent in workability. That is, it is recommended that after heating and maintaining steel which satisfies the component composition above at a temperature between ($Ac_3$ point+20° C.) and ($Ac_3$ point+70° C.) for 20-500 seconds, the steel is cooled down to a temperature range of 480-350° C. at an average cooling rate of 5-20° C./sec and then maintained or gradually cooled in this temperature range for 100-400 seconds. Each processing will now be described in detail with reference to a schematic diagram (FIG. 4) of a thermal treatment pattern.

Figure 4:
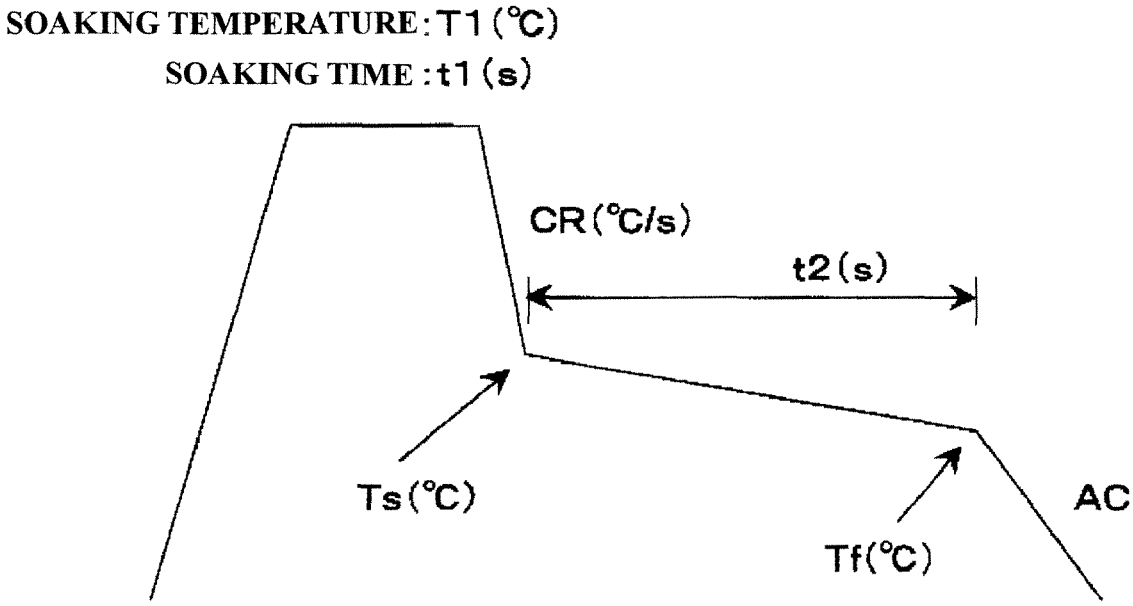
FIG. 4 is a schematic diagram for describing a typical thermal treatment pattern.

First, the steel which satisfies the component composition above is heated and maintained (soaking) at a temperature (T1 in FIG. 4) between ($Ac_3$ point+20° C.) and ($Ac_3$ point+70° C.) for 20-500 seconds (t1 in FIG. 4). T1 (soaking temperature) is extremely important in obtaining residual austenite. When T1 is excessively high, it becomes difficult to obtain residual austenite and the structure easily changes to bainite. On the contrary, when T1 is too low, the dislocation density becomes high, which makes it hard to obtain a steel sheet which is excellent in terms of strength-workability balance. Further, soaking for a long period so that t1 (soaking time) exceeds 500 seconds lowers the productivity. On the contrary, when t1 is below 20 seconds, cementite and other carbides are remained without sufficient austenitizing.

Considering this, it is more preferable that T1 is from 850° C. to 900° C.

The steel sheet is cooled after soaking. The present invention first requires cooling at the average cooling rate of 5-20° C./sec (CR in FIG. 4) down into a temperature range of 480-350° C. (Ts in FIG. 4).

Control of the average cooling rate (CR) above is important in obtaining a steel sheet which satisfies the Fe-peak half-value width specified in the present invention, and to this end, the average cooling rate is controlled to 20° C./sec or slower, and preferably to 15° C./sec or slower. On the contrary, when the cooling rate is too slow, soft polygonal ferrite is generated during cooling, which prevents sufficient generation of bainitic ferrite. Hence, the average cooling rate is preferably 5° C./sec or faster, and further preferably 8° C./sec or faster.

After the cooling above at the average cooling rate of 5-20° C./sec (CR) down into the temperature range of 480-350° C. (Ts), the steel sheet is maintained or gradually cooled (austemper processing) in this temperature range (Ts-Tf in FIG. 4) for 100-400 seconds (t2 in FIG. 4). Retention or gradual cooling in this temperature range makes it possible to sufficiently obtain residual austenite. Austemper processing in a higher temperature range than this temperature range makes it impossible to sufficiently obtain residual austenite. Austemper processing in a lower temperature range than this temperature range however reduces residual austenite, which is not desirable.

Meanwhile, when the austemper processing time (t2) is longer than 400 seconds, predetermined residual austenite can not be obtained. If t2 is shorter than 100 seconds however, it is not possible to obtain a steel sheet having a low dislocation density which meets the Fe-peak half-value width specified in the present invention. It is preferable that t2 is from 120 to 350 seconds (further preferably, 300 seconds or shorter), and judging from such a tendency, it is still further preferable that t2 is from 150 to 300 seconds. A method of cooling after austemper processing is not particularly limited and may be air cooling (AC), quenching, steam cooling, etc.

In light of an actual operation, it is convenient to perform the thermal treatment above using a continuous annealing machine. In the event that the cold-rolled sheet is to be plated with zinc, e.g., by hot dip galvanizing, the hot dip galvanizing may be performed after the thermal treatment under the appropriate conditions described above and an alloying thermal treatment may thereafter be carried out. Alternatively, galvanizing conditions or hot dip galvanizing conditions may be set such that a part of these conditions satisfies the thermal treatment conditions above, and the thermal treatment above may be performed at this galvanizing step.

Further, a hot rolling step, a cold rolling step and the like prior to the thermal treatment are not particularly limited, and an ordinary condition may be properly selected and used for execution. Specifically, conditions for the hot rolling step above may be hot rolling at the Ar3 point or a higher temperature which is followed by cooling at an average cooling rate of approximately 30° C./sec and coiling at a temperature of about 500-600° C. When the shape after hot rolling is poor, cold rolling may be performed for the purpose of modifying the shape. It is recommended that the cold rolling rate is 30-70%. This is because cold rolling at a cold rolling rate over 70% increases a rolling load and makes rolling difficult.

While the present invention is directed to a cold-rolled steel sheet, the form of a product is not particularly limited. Besides a steel sheet which is obtained through cold rolling and annealing, the present invention encompasses plated steel sheets as well obtained by further chemical conversion, hot dipping, electroplating, vapor deposition plating, etc.

The type of this plating may be any one of galvanizing, aluminum plating and any other ordinary plating. Further, a plating method may be any one of hot dipping and electroplating. In addition, an alloying thermal treatment may follow plating, or alternatively, multi-layer plating may be performed. Further alternatively, the non-plated steel sheet or the plated steel sheet may be film-laminated.

The high-strength steel sheet according to the present invention is most suitable to manufacturing of automotive parts and components, such as pillars and side frames, which demand a high strength, high workability and crashworthiness. When applied to parts and components molded in this manner as well, the high-strength steel sheet according to the present invention exhibits a satisfactory property (strength) as the material.

While the present invention will now be described in more detail in relation to examples, the examples below do not restrict the present invention. The present invention may be implemented with appropriate modifications only to the extent meeting the intentions described earlier and below, and any such modification falls under the technical scope of the present invention.

EXAMPLE

After melting steel grades Nos. 1-13 having the component compositions shown in Table 2 and obtaining slabs, following the steps below (hot rolling->cold rolling->continuous annealing), a hot-rolled steel sheet having the sheet thickness of 3.2 mm was obtained, which was followed by acid pickling to thereby remove scales on the surfaces and thereafter cold rolling until the thickness became 1.2 mm.

<Hot Rolling Step>

Start temperature (SRT): retention for 30 minutes at 1150-1250° C.

Finishing temperature (FDT): 850° C.

Cooling rate (CR): 40° C./sec

Coiling temperature: 550° C.

<Cold Rolling Step>

Cold rolling ratio: 50%

<Continuous Annealing Step>

Each steel material was annealed with the thermal treatment pattern shown in FIG. 4. That is, after retention at T1 (° C.) in Table 3 for 200 seconds (t1), cooling (water cooling) was performed at CR (average cooling rate) in Table 3 down to Ts (° C.) in Table 3, and gradual cooling was performed from Ts (° C.) down to Tf (° C.) for t2 seconds. Air cooling then followed, whereby a steel sheet was obtained.

Figure 5:
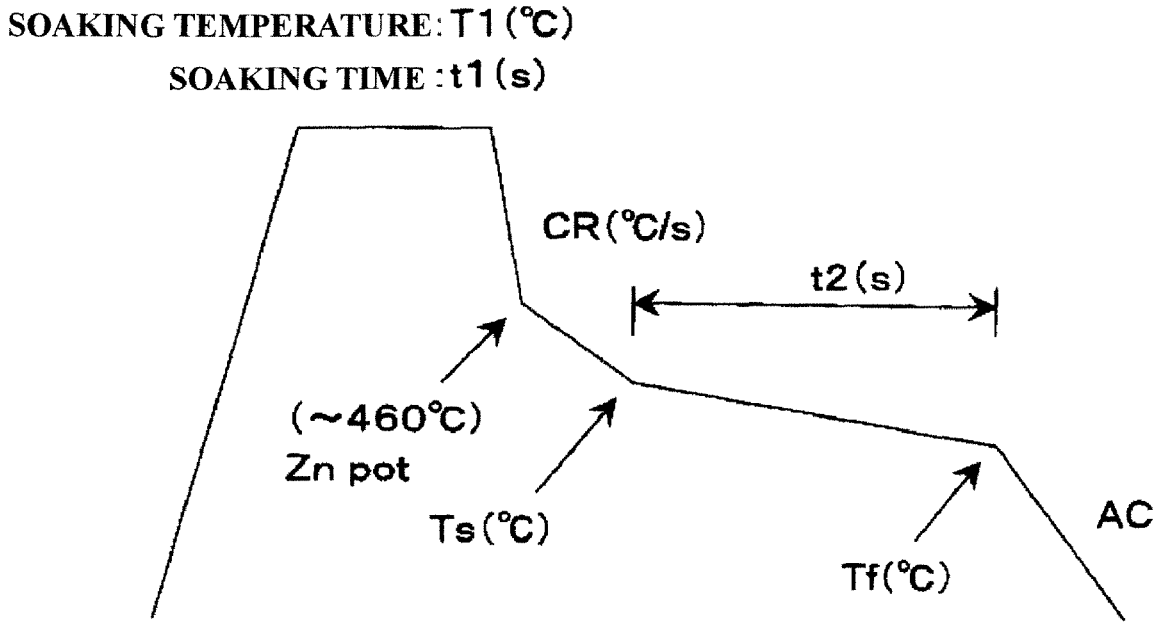
FIG. 5 is a schematic diagram for describing another typical thermal treatment pattern.

Indicated as No. 28 in Table 3 is a galvanized sample, for which after cooling at CR (average cooling rate) down to 480° C. or below following soaking, galvanizing was carried out at 460° C. and gradual cooling was performed in a similar manner to that described above as shown in FIG. 5, thereby obtaining a galvanized steel sheet.

The metal structure, the Fe-peak half-value width appearing in X-ray diffraction, the yield strength (YS), the tensile strength (TS), elongation [total elongation (El)], the hole expanding capability (λ) and the hardness (Hv) of each one of thus obtained steel sheets were examined in the following manner.

[Observation of Metal Structure]

As for the space factor of bainitic ferrite, an arbitrarily chosen measurement area (approximately 50 μm×50 μm with measurement intervals of 0.1 μm) in the parallel surface to a rolling surface at a location corresponding to ¼ of the sheet thickness of the product was repeller-corroded and observed with an optical microscope (at the magnification of 1,000×), the area was then electrolytically grinded and observed with a transmission electron microscope (TEM) (at the magnification of 15,000×), thereby identifying the structure, and based on the information regarding the structure identified through the TEM observation, the area % of each structure was calculated from the measurement result of the observation with the optical microscope. In ten fields chosen arbitrarily, similar measurements were taken and their average value was calculated.

Meanwhile, the space factor (volume %) of residual austenite was measured by a saturated magnetization measuring method [JP 2003-90825, A, and Kobe Steel R&D Technical Report, Vol. 52, No. 3 (December 2002)]. As for the other structures (such as martensite), the space factor was calculated by subtracting the space factor of the structure above from the entire structure (100%).

[Fe-Peak Half-Value Width Appearing in X-Ray Diffraction]

A 30 W-times-30 L sample was taken from the center of a test material along the sheet width, and after thickness reduction through emery polishing for the purpose of measuring a ¼t part (where t is the sheet thickness), the sample was chemically polished. Using RINT-1500 available from Rigaku Corporation as an X-ray diffraction apparatus, the half-value width of a peak on Fe (α-iron) constituting the matrix was analyzed based on X-ray analysis by the θ-20 method, and the half-value width of a peak appearing in the vicinity of 26.1-31.1 degrees in the (200)-surface was calculated. This measurement was conducted at three locations which were chosen arbitrarily, and an average value of the same was calculated. Other conditions for X-ray diffraction were as follows:

<Measurement Conditions for X-Ray Diffraction>
Target: Mo
Accelerating Voltage: 50 kV
Accelerating Current: 200 mA
Slit: DS . . . 1 degree, RS . . . 0.15 mm, SS . . . 1 degree
Scanning Speed: 1 degree/min

[Measurement of Tensile Strength (TS) and Elongation (El)]

A tensile test was conducted using JIS test samples No. 5, which measured the tensile strength (TS) and the elongation (El). The strain rate for the tensile test was 1 mm/sec.

[Measurement of Hole Expanding Capability (λ)]

A stretch flange test was conducted to measure the hole expanding capability (λ). The stretch flange test used a disk-shaped test specimen whose diameter was 100 mm and sheet thickness was 2.0 mm. After punching a hole having ϕ10 mm, the specimen was subjected to hole expanding processing using a 60-degree conical punch with burrs facing above, and the hole expanding capability λ) was measured upon fracture penetration (JFST1001, the standard adopted by the Japan Iron and Steel Federation).

[Measurement of Hardness (Hv)]

Using a Vickers hardness gauge, measurements were taken at three locations on each steel material under a load of 9.8 N, and an average value was calculated.

Table 4 shows the results.

TABLE 2

| STEEL GRADE | CHEMICAL COMPONENT (mass %)※ | | | | | | | Ac3 POINT |
|---|---|---|---|---|---|---|---|---|
| No. | C | Si | Mn | P | S | Al | OTHERS | (° C.) |
| 1 | 0.08 | 1.4 | 2.5 | 0.005 | 0.002 | 0.034 | — | 854 |
| 2 | 0.12 | 1.5 | 2.5 | 0.006 | 0.001 | 0.035 | — | 846 |
| 3 | 0.20 | 1.4 | 2.4 | 0.008 | 0.002 | 0.035 | — | 824 |
| 4 | 0.24 | 1.5 | 2.5 | 0.005 | 0.001 | 0.035 | — | 820 |
| 5 | 0.18 | 0.7 | 2.4 | 0.005 | 0.001 | 0.035 | — | 794 |

TABLE 2-continued

| STEEL GRADE | CHEMICAL COMPONENT (mass %)※ | | | | | | | Ac3 POINT |
|---|---|---|---|---|---|---|---|---|
| No. | C | Si | Mn | P | S | Al | OTHERS | (° C.) |
| 6 | 0.18 | 1.5 | 2.5 | 0.005 | 0.001 | 0.035 | — | 830 |
| 7 | 0.18 | 1.6 | 1.2 | 0.003 | 0.001 | 0.035 | — | 873 |
| 8 | 0.18 | 1.6 | 1.8 | 0.004 | 0.001 | 0.035 | — | 855 |
| 9 | 0.18 | 1.4 | 2.5 | 0.007 | 0.001 | 0.035 | Mo: 0.2 | 832 |
| 10 | 0.18 | 1.4 | 2.4 | 0.004 | 0.002 | 0.035 | Cr: 0.2 | 826 |
| 11 | 0.18 | 1.5 | 2.5 | 0.005 | 0.002 | 0.035 | Ti: 0.02 | 830 |
| 12 | 0.18 | 1.5 | 2.5 | 0.005 | 0.002 | 0.035 | Nb: 0.06 | 830 |
| 13 | 0.18 | 1.5 | 2.4 | 0.005 | 0.001 | 0.035 | Ca: 14 ppm | 830 |

※The remaining part is iron and inevitable impurities.

TABLE 3

| GROUP | TEST No. | STEEL GRADE No. | T1 (° C.) | CR (° C./s) | Ts (° C.) | Tf (° C.) | t2 (s) |
|---|---|---|---|---|---|---|---|
| A | 1 | 1 | 880 | 10 | 450 | 400 | 200 |
| | 2 | 2 | 880 | 10 | 450 | 400 | 200 |
| | 3 | 3 | 880 | 10 | 450 | 400 | 200 |
| | 4 | 4 | 880 | 10 | 450 | 400 | 200 |
| B | 5 | 5 | 880 | 10 | 450 | 400 | 200 |
| | 6 | 6 | 880 | 10 | 450 | 400 | 200 |
| C | 7 | 7 | 880 | 10 | 450 | 400 | 200 |
| | 8 | 8 | 880 | 10 | 450 | 400 | 200 |
| | 6 | 6 | 880 | 10 | 450 | 400 | 200 |
| D | 9 | 9 | 880 | 10 | 450 | 400 | 200 |
| | 10 | 10 | 880 | 10 | 450 | 400 | 200 |
| | 11 | 11 | 880 | 10 | 450 | 400 | 200 |
| | 12 | 12 | 880 | 10 | 450 | 400 | 200 |
| | 13 | 13 | 880 | 10 | 450 | 400 | 200 |
| E | 14 | 6 | 910 | 10 | 450 | 400 | 200 |
| | 15 | 6 | 900 | 10 | 450 | 400 | 200 |
| | 16 | 6 | 890 | 10 | 450 | 400 | 200 |
| | 17 | 6 | 880 | 10 | 450 | 400 | 200 |
| | 18 | 6 | 870 | 10 | 450 | 400 | 200 |
| F | 19 | 6 | 880 | 3 | 450 | 400 | 200 |
| | 20 | 6 | 880 | 5 | 450 | 400 | 200 |
| | 21 | 6 | 880 | 10 | 450 | 400 | 200 |
| | 22 | 6 | 880 | 20 | 450 | 400 | 200 |
| | 23 | 6 | 880 | 40 | 450 | 400 | 200 |
| G | 24 | 6 | 880 | 10 | 450 | 400 | 50 |
| | 25 | 6 | 880 | 10 | 450 | 400 | 200 |
| | 26 | 6 | 880 | 10 | 450 | 400 | 500 |
| | 27 | 6 | 880 | 10 | 500 | 450 | 200 |
| H※ | 28 | 6 | 880 | 10 | 450 | 400 | 200 |

※Zn PLATING

TABLE 4

| GROUP | TEST No. | STEEL GRADE No. | STRUCTURE BF (%) | RESIDUAL γ (%) | OTHERS (%) | HALF-VALUE WIDTH OF PEAK (DEGREES) ON (200)-SURFACE (°) | MECHANICAL PROPERTY YS (MPa) | TS (MPa) | EI (%) | λ (%) | HV | TS × EI |
|---|---|---|---|---|---|---|---|---|---|---|---|---|
| A | 1 | 1 | 94 | 4 | 2 | 0.191 | 630 | 780 | 23 | 54 | 233 | 17940 |
| | 2 | 2 | 88 | 9 | 3 | 0.191 | 560 | 880 | 23 | 55 | 272 | 20240 |
| | 3 | 3 | 85 | 14 | 1 | 0.190 | 730 | 1040 | 22 | 47 | 330 | 22880 |
| | 4 | 4 | 83 | 13 | 4 | 0.189 | 910 | 1302 | 20 | 44 | 440 | 26040 |
| B | 5 | 5 | 92 | 4 | 4 | 0.189 | 735 | 1050 | 18 | 48 | 320 | 18900 |
| | 6 | 6 | 84 | 13 | 3 | 0.187 | 713 | 1020 | 23 | 43 | 300 | 22440 |
| C | 7 | 7 | 90 | 4 | 6 | 0.191 | 693 | 990 | 20 | 53 | 298 | 19800 |
| | 8 | 8 | 86 | 10 | 4 | 0.190 | 716 | 1024 | 20 | 44 | 308 | 20480 |
| | 6 | 6 | 84 | 13 | 3 | 0.187 | 713 | 1020 | 23 | 43 | 300 | 22440 |
| D | 9 | 9 | 85 | 12 | 3 | 0.190 | 783 | 1130 | 18 | 45 | 339 | 20340 |
| | 10 | 10 | 83 | 12 | 5 | 0.189 | 784 | 1100 | 19 | 44 | 335 | 20900 |
| | 11 | 11 | 85 | 11 | 4 | 0.189 | 790 | 1140 | 18 | 46 | 340 | 20520 |
| | 12 | 12 | 85 | 12 | 3 | 0.190 | 797 | 1100 | 19 | 47 | 340 | 20900 |
| | 13 | 13 | 83 | 12 | 5 | 0.191 | 772 | 1103 | 19 | 62 | 330 | 20957 |
| E | 14 | 6 | 85 | 4 | 11 | 0.189 | 720 | 1030 | 19 | 40 | 330 | 19570 |
| | 15 | 6 | 93 | 3 | 4 | 0.188 | 718 | 1030 | 19 | 42 | 328 | 19570 |
| | 16 | 6 | 87 | 8 | 5 | 0.187 | 733 | 1050 | 20 | 41 | 319 | 21000 |
| | 17 | 6 | 85 | 13 | 2 | 0.186 | 721 | 1064 | 22 | 44 | 340 | 23408 |
| | 18 | 6 | 84 | 10 | 6 | 0.255 | 702 | 1050 | 19 | 43 | 302 | 19950 |
| F | 19 | 6 | 50 | 12 | 38 | 0.181 | 600 | 900 | 19 | 41 | 271 | 17100 |
| | 20 | 6 | 76 | 13 | 11 | 0.183 | 700 | 1020 | 21 | 42 | 297 | 21420 |
| | 21 | 6 | 84 | 13 | 3 | 0.189 | 771 | 1102 | 22 | 50 | 330 | 24244 |
| | 22 | 6 | 85 | 11 | 4 | 0.193 | 726 | 1040 | 19 | 51 | 330 | 19760 |
| | 23 | 6 | 85 | 12 | 3 | 0.244 | 733 | 1050 | 18 | 48 | 332 | 18900 |
| G | 24 | 6 | 90 | 3 | 7 | 0.245 | 751 | 1075 | 15 | 49 | 340 | 16125 |
| | 25 | 6 | 86 | 12 | 2 | 0.198 | 711 | 1025 | 22 | 49 | 310 | 22550 |
| | 26 | 6 | 92 | 1 | 7 | 0.199 | 733 | 1044 | 18 | 48 | 312 | 18792 |
| | 27 | 6 | 91 | 3 | 6 | 0.200 | 730 | 1055 | 17 | 47 | 332 | 17935 |
| H※ | 28 | 6 | 85 | 13 | 2 | 0.191 | 770 | 1120 | 22 | 44 | 330 | 24640 |

※Zn PLATING

An observation from Tables 2 through 4 is as follows (The reference numbers below denote the test numbers shown in Tables 3 and 4.).

On the group A in Tables 3 and 4, the influence by the amount of C was examined. Nos. 2 to 4 satisfied the requirements according to the present invention and therefore provided steel sheets excellent in strength-workability balance. Meanwhile, No. 1 contained too little C, the hardness of the steel sheets was low, residual austenite was not sufficiently obtained, and the balance between the strength and the workability was poor.

On the group B, the influence by the amount of Si was examined. No. 6 satisfied the requirements according to the present invention and therefore provided a steel sheet excellent in strength-workability balance. Meanwhile, No. 5 contained an insufficient amount of Si, and hence, an insufficient amount of residual austenite. Total elongation was not enough, and the strength-workability balance was poor.

On the group C, the influence by the amount of Mn was examined. No. 8 and No. 6 satisfied the requirements according to the present invention and therefore provided steel sheets excellent in strength-workability balance. Meanwhile, No. 7 contained a small amount of Mn, and hence, an insufficient amount of residual austenite. Thus, residual austenite was not sufficiently obtained, which worsened the balance between the strength and the workability.

On the group D, the influence by the optional elements was examined. Where appropriate amounts of the elements Mo, Cr, Ti, Nb and Ca were added as well, steel sheets excellent in strength-workability balance were obtained.

The groups E through H are examples of manufacturing steel sheets using the steel material of the steel grade No. 6 having a component composition satisfying the requirements according to the present invention, while changing the manufacturing conditions.

On the group E, the influence by the soaking temperature was examined. Nos. 16 and 17, due to heating at recommended temperatures, provided desirable structures and exhibited an excellent strength-workability balance.

On the group F, the influence by the cooling rate after soaking was examined. Nos. 20 to 22, owing to cooling at recommended cooling rates, provided desirable structures exhibiting an excellent strength-workability balance. Meanwhile, due to the slow cooling rate, No. 19 failed to sufficiently ensure bainitic ferrite and resulted in a poor strength-workability balance. No. 23, due to the fast cooling rate, increased the Fe-peak half-value width and resulted in a poor strength-workability balance.

On the group G, the influence by the thermal treatment conditions was examined. No. 25 attained the desired structure exhibiting an excellent strength-workability balance owing to austemper processing under the recommended conditions. Meanwhile, owing to the excessively short austemper processing time, No. 24 failed to sufficiently provide residual austenite and increased the Fe-peak half-value width, which worsened the balance between the strength and the workability. Because of the excessively long austemper processing time, No. 26 as well failed to sufficiently ensure residual austenite and increased the Fe-peak half-value width, which worsened the balance between the strength and the workability. No. 27, due to the higher austemper processing temperature range, failed to sufficiently provide residual austenite, thereby worsening the balance between the strength and the workability.

Galvanizing was performed on the group H (No. 28). The galvanized steel sheet as well fully attained the effect of the present invention.

The invention claimed is:

1. A high-strength cold-rolled steel sheet having a matrix comprising bainitic ferrite and residual austenite, wherein said high-strength cold-rolled steel sheet comprises:

0.10-0.25 wt. % C;

1.0-2.0 wt. % Si;

1.5-3.0 wt. % Mn;

0.01 wt. % or less, not including 0 wt. %, P;

0.005 wt. % or less, not including 0 wt. %, S;

0.01-3.0 wt. % Al; and balance consisting of iron and impurities, wherein said bainitic ferrite exhibits a space factor within said matrix of 70% or more, wherein said residual austenite exhibits a space factor within said matrix of 5-20%, wherein said high-strength cold-rolled steel sheet exhibits a Vickers hardness number of 270 or greater, and wherein an X-ray diffraction peak on a (200)-surface of $\alpha$-iron has a half-value width of 0.220 degrees or less.

2. The high-strength cold-rolled steel sheet according to claim 1, further comprising:

0.3 wt. % or less, not including 0 wt. %, Mo; and/or 0.3 wt. % or less, not including 0 wt. %, Cr.

3. The high-strength cold-rolled steel sheet according to claim 1, further comprising:

0.1 wt. % or less, not including 0 wt. %, Ti; and/or 0.1 wt. % or less, not including 0 wt. %, Nb.

4. The high-strength cold-rolled steel sheet according to claim 1, further comprising:

50 mass ppm or less, not including 0 mass ppm, Ca.

5. A plated steel sheet produced by a process comprising plating a surface of said high-strength cold-rolled steel sheet according to claim 1.

6. The plated steel sheet according to claim 5, wherein said plating is galvanizing.

7. The high strength cold-rolled steel sheet according to claim 1, wherein the bainitic ferrite exhibits a space factor within said matrix of 70% to 95%.

8. The high strength cold-rolled steel sheet according to claim 1, wherein the bainitic ferrite exhibits a space factor within said matrix of 80% to 95%.

9. The high strength cold-rolled steel sheet according to claim 1, wherein the bainitic ferrite exhibits a space factor within said matrix of 90% to 95%.

10. The high strength cold-rolled steel sheet according to claim 1, wherein the residual austenite exhibits a space factor within said matrix of 8-20%.

11. The high strength cold-rolled steel sheet according to claim 1, wherein the residual austenite exhibits a space factor within said matrix of 10-20%.

12. The high strength cold-rolled steel sheet according to claim 1, wherein the residual austenite exhibits a space factor within said matrix of 15-20%.

13. The high strength cold-rolled steel sheet according to claim 1, wherein the high-strength cold-rolled steel sheet comprises 0.10-0.23 wt. % C.

14. The high strength cold-rolled steel sheet according to claim 1, wherein the high-strength cold-rolled steel sheet comprises 0.15-0.23 wt. % C.

15. The high strength cold-rolled steel sheet according to claim 1, wherein the high-strength cold-rolled steel sheet comprises 0.18-0.23 wt. % C.

16. The high strength cold-rolled steel sheet according to claim 1, wherein the X-ray diffraction peak on a (200)-surface of $\alpha$-iron has a half-value width of 0.205 degrees or less.

17. The high strength cold-rolled steel sheet according to claim 1, wherein the X-ray diffraction peak on a (200)-surface of $\alpha$-iron has a half-value width of from 0.180 degrees to 0.205 degrees.

* * * * *